US006939508B2

(12) United States Patent
Bampton et al.

(10) Patent No.: US 6,939,508 B2
(45) Date of Patent: Sep. 6, 2005

(54) METHOD OF MANUFACTURING NET-SHAPED BIMETALLIC PARTS

(75) Inventors: Clifford C. Bampton, Thousand Oaks, CA (US); Victor Samarov, Anaheim, CA (US)

(73) Assignee: The Boeing Company, Chicago, IL (US)

( * ) Notice: Subject to any disclaimer, the term of this patent is extended or adjusted under 35 U.S.C. 154(b) by 229 days.

(21) Appl. No.: 10/279,780

(22) Filed: Oct. 24, 2002

(65) Prior Publication Data

US 2004/0081572 A1 Apr. 29, 2004

(51) Int. Cl.[7] ..... B22F 3/00

(52) U.S. Cl. ..... 419/5; 419/6; 419/48; 419/49

(58) Field of Search ..... 419/5, 6, 48, 49

(56) References Cited

U.S. PATENT DOCUMENTS

| | | | | | |
|---|---|---|---|---|---|
| 4,023,966 | A | * | 5/1977 | Loersch et al. | 419/49 |
| 4,145,481 | A | * | 3/1979 | Gupta et al. | 428/678 |
| 4,212,669 | A | * | 7/1980 | Veeck et al. | 419/6 |
| 4,383,854 | A | | 5/1983 | Dembowski et al. | 419/1 |
| 4,421,717 | A | | 12/1983 | Rao | 419/27 |
| 4,772,450 | A | * | 9/1988 | Friedman | 419/49 |
| 5,960,249 | A | * | 9/1999 | Ritter et al. | 419/6 |
| 6,044,555 | A | | 4/2000 | Jacob et al. | 29/893.34 |
| 6,132,527 | A | * | 10/2000 | Hessell et al. | 148/410 |
| 6,210,633 | B1 | | 4/2001 | Kratt et al. | 419/49 |
| 6,224,798 | B1 | | 5/2001 | Gay | 264/102 |
| 6,250,883 | B1 | | 6/2001 | Robinson et al. | 416/198 A |
| 6,340,424 | B1 | | 1/2002 | Elman et al. | 205/645 |
| 6,410,153 | B1 | * | 6/2002 | Broomfield et al. | 428/469 |

FOREIGN PATENT DOCUMENTS

| | | |
|---|---|---|
| EP | 0 090 118 | * 10/1983 |

* cited by examiner

*Primary Examiner*—Ngoclan T. Mai
(74) *Attorney, Agent, or Firm*—Harness Dickey & Pierce P.L.C.

(57) ABSTRACT

A method for manufacturing a net-shaped bimetallic part that includes the steps of: providing a tool that defines a cavity and a tooling surface; depositing a layer of an environmental metal material onto the tooling surface; filling the cavity in the tool with a powdered metal material; and simultaneously heating the tool and subjecting the tool to a pressurized gas to consolidate the powdered metal material and diffusion bond the environmental metal material to the consolidated powdered metal material to form a bimetallic part.

32 Claims, 1 Drawing Sheet

METHOD OF MANUFACTURING NET-SHAPED BIMETALLIC PARTS

FIELD OF THE INVENTION

The present invention relates to a method for manufacturing bimetallic parts with a surface layer of an environmentally compatible alloy that has been diffusion bonded to a surface of a powdered metal material during hot isostatic pressing (HIP) operation.

BACKGROUND OF THE INVENTION

Highly stressed turbine components, such as integrally bladed turbine rotors or blisks (bladed disks), are used in a wide variety of environments, such as in gaseous hydrogen, gaseous oxygen, and high concentration hydrogen peroxide systems. Often times, these components are manufactured by consolidating a powdered metal material, such as a conventional high-strength, nickel-based superalloy that is subsequently coated for environmental protection, or made from a moderate strength alloy that is fully compatible with the applicable environment.

However, conventional coatings can introduce reliability and cost issues while the moderate strength alloys potentially sacrifice some strength. Moreover, when hot isostatic pressing of a powdered metal material is employed to net shape the article, both of these alternatives suffered from surface micro-roughness and surface contamination by carbon diffusion when known hot isostatic pressing techniques had been employed. These problems were due to powder indentation and diffusion bonding with the soft tooling used during consolidation of the powdered metal and could result in reduced high cycle fatigue life.

SUMMARY OF THE INVENTION

In one preferred form, the present invention provides a method for manufacturing a bimetallic part. The method includes the steps of: providing a tool that defines a cavity and a tooling surface; depositing a layer of an environmental metal material onto the tooling surface; filling the cavity in the tool with a powdered metal material; and simultaneously heating and subjecting the tool to a pressurized gas to consolidate the powdered metal material. During this process, the environmental metal material is diffusion bonded to the consolidated metal material to thereby form a bimetallic part. Preferably, the tooling surface is formed (e.g., machined) with a surface finish that corresponds to a desired surface finish of the finished bimetallic part so that the part may be formed in a net-shaped or near net-shaped manner. Furthermore, the tooling is preferably formed from a material having a carbon content that closely matches that of the environmental metal material. A bimetallic article having a first portion that is formed from a consolidated powdered metal material and second portion that is formed from an environmental metal material and diffusion bonded to the first portion is also provided.

The method of the present invention overcomes the aforementioned drawbacks through the use of a shell that is HIP diffusion bonded to the powdered metal to form the environmentally exposed surface of the component. This construction technique permits a designer to select the materials for the shell and the powdered metal in a manner that obtains compatibility with the operating environment without compromising other desirable characteristics, such as relatively high strength and a relatively low coefficient of thermal expansion. Accordingly, the methodology of the present invention permits the net-shaping or near net-shaping of an article having an enhanced surface in areas that may not have been reachable through conventional coating processes, that includes a layer of an environmentally compatible material and also with a good surface finish. Furthermore, as the powdered metal indents the internal surface of the shell of environmental metal material, this surface of the environmental metal material is deformed and any oxide films on the surface are disrupted to thereby permit the bond to achieve a relatively high degree of quality and integrity. The external surface of the shell is not deformed and it reproduces the surface finish of the tooling.

As the shell and the powdered metal material are fixedly secured to one another through a high strength diffusion bond, any risks of delamination and/or chipping of the environmentally exposed surface during the use of the fabricated component are greatly reduced. Concerns for micro-roughness, as well as carbon diffusion into the powdered metal material may be readily avoided through appropriate sizing of the shell and appropriate tooling material selections as will be discussed in greater detail, below.

Further areas of applicability of the present invention will become apparent from the detailed description provided hereinafter. It should be understood that the detailed description and specific examples are intended for purposes of illustration only and are not intended to limited the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
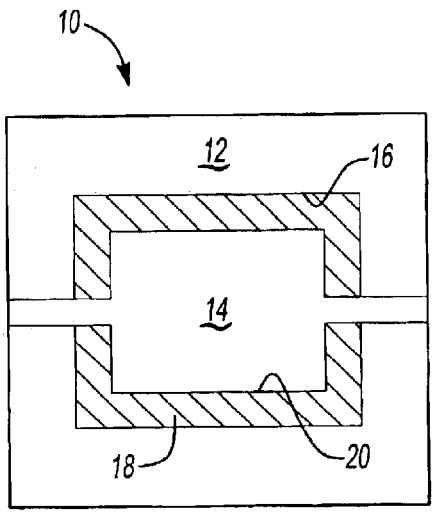
FIG. 1 is a schematic view of the tool assembly according to the present invention.

There is shown in FIG. 1 a schematic diagram of a tool assembly 10. The tool assembly 10 comprises a tool 12 having a pair of tool halves that cooperate to define a cavity 14 having a tooling surface 16. As those skilled in the art will appreciate, the tooling surface 16 may be machined to conform to a predetermined contour to provide net-shape or near net-shape forming capabilities. In instances where the net-shape or near net-shape forming capabilities are desired, the tooling surface 16 is preferably formed with a surface finish that conforms to the desired surface finish of the finished article. Preferably, the tool 12 is formed from a material with a carbon content that closely matches the carbon content of the environmental metal material 18. In the particular example provided, the tool 12 is made from a ferrous material, preferably high purity soft iron with low carbon content. However, it is not intended that the tool 12 be limited to a soft iron with low carbon content.

A layer of an environmental metal material 18 is deposited on the tooling surface 16 of the tool 12 creating an exposed inner surface 20. In the particular example provided, the environmental metal material 18 is deposited onto the tooling surface 16 by low pressure plasma spraying. Those skilled in the art will appreciate, however, that various alternate methods of depositing the environmental metal material 18 onto the tooling surface 16 may also be employed, including wire arc spraying, kinetic energy metallization, and direct laser deposition.

The particular deposition method that is utilized must be capable of depositing the environmental metal material 18 onto the tooling surface 16 such that the amount of impurities in the layer of the environmental metal material 18 do not exceed a desired threshold. In one test, we employed an air plasma spraying deposition technique that introduced a significant quantity of Cr-oxide flakes into the layer of the environmental metal material 18, which, as those skilled in the art will readily appreciate, are generally unacceptable for highly loaded structural components such as blisks. However, as the methodology of the present invention has application to the fabrication of other components besides highly loaded structural components, those skilled in the art will appreciate that the method of the present invention in its broader aspects is not to be limited in scope to any particular deposition method.

The environmental metal material 18 is selected for its resistance to a given predetermined environmental condition, as well as its compatibility with the powdered metal material 22. For example, the environmental metal material 18 may be made from a nickel, Ni—Cr or nickel-based superalloy for use in oxygen-rich environments, or an iron-based superalloy such as A286 for hydrogen-rich environments, or a 300-series stainless steel for peroxide-rich environments. However, the environmental metal material 18 is not limited to these examples or compatibility in these environments.

Figure 2:
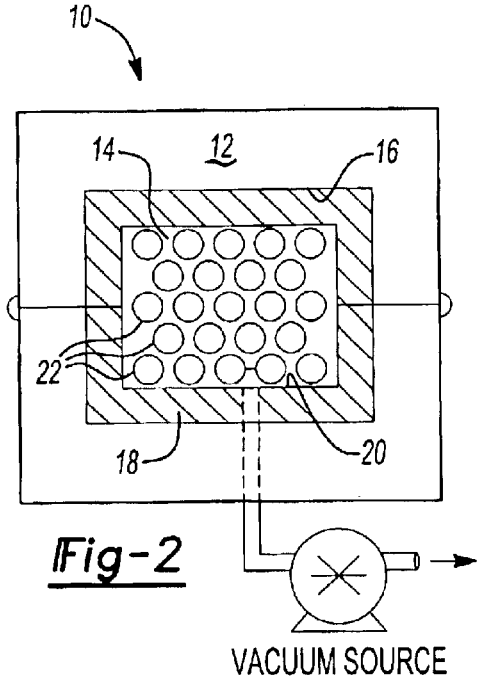
FIG. 2 is a schematic view of the tool assembly filled with a powdered metal according to the present invention.

Referring now to FIG. 2, the cavity 14 of the tool 12 is filled with a powdered metal material 22. The powdered metal material 22 is selected on the basis of various design criteria for the finished article. In the particular example provided, the basis for the selection of the powdered metal material 22 is its strength and as such, a 720-alloy, which is well known in the art, was selected. Those skilled in the art will appreciate that the invention is in no way limited to a particular criteria or characteristic for the selection of the powdered metal material 22 and that the powdered metal material 22 need not be limited to any specific alloy disclosed herein or to a high strength superalloy.

In some applications, the presence of voids within the finished bimetallic part is highly undesirable. Accordingly, it may be necessary and appropriate in certain situations to degas the powdered metal material 22 within the cavity 14 of the tool assembly 10. As is well known in the art, various vacuum devices may be employed in a degassing operation.

The tool assembly 10, whether degassed or not, is sealed to prevent pressurized gasses from entering the tool assembly 10 during the next steps of the methodology. The tool assembly 10 may be sealed in various different ways, including the use of high pressure seals between the halves of the tool assembly 10. Alternatively, the halves of the tool assembly 10 may be sealingly welded to one another.

The tool assembly 10 is placed in an autoclave (not shown) wherein the tool assembly 10 is simultaneously heated and subjected to a pressurized gas to hot isostatically press or consolidate the powdered metal material 22 and diffusion bond the environmental metal material 18 to the powdered metal material 22. The environmental metal material 18 limits carbon diffusion from the tool 12 to the powdered metal material 22 during the step of simultaneously heating and subjecting the tool to the pressurized gas. As those skilled in the art will appreciate, carbon diffusion into the environmental metal material 18 may adversely affect certain properties, such as high cycle fatigue strength. Accordingly, it is highly desirable that the material for the tool 12 be selected to closely match its carbon content to the carbon content of the environmental metal material 18 to thereby significantly limit or eliminate altogether concerns for carbon diffusion. Furthermore, highly finishing the tooling surface 16, along with the building-up the layer of the environmental metal material 18 to a sufficient thickness to prevent the powdered metal material 22 from indenting the tool 12 (as will be discussed below) may be employed to reduce the effectiveness of the mechanism that facilitates carbon diffusion to thereby further reduce concerns for carbon diffusion.

Figure 3:
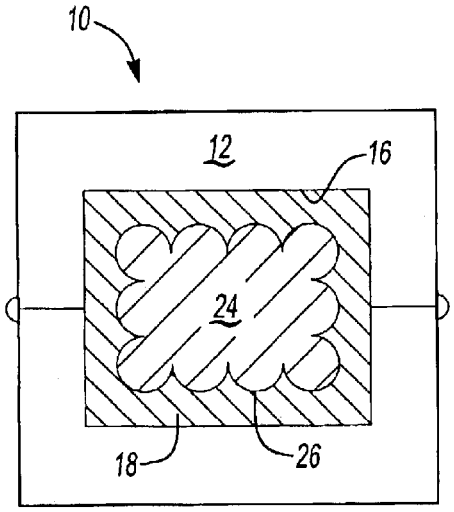
FIG. 3 is a schematic view of the tool assembly after consolidation of the powdered metal according to the present invention.

As seen in FIG. 3, the powdered metal material 22 is consolidated to form an inner consolidated powder metal core 24. The hot isostatic pressing operation works to not only close all porosity in the consolidated powder metal core 24, but also in the environmental metal material 18 if the environmental metal material 18 is deposited through a method, such as low pressure plasma spraying, for example, in which the deposit is not fully dense as deposited.

During consolidation, the powder particles of the inner core 24 indents the exposed inner surface 20 of environmental metal material 18 forming a rough interface 26 between the inner core 24 and the environmental metal material 18. This rough interface 26 provides greater surface area for the diffusion bond and mechanically breaks any oxide layer formed on the inner surface 20 of the environmental metal material 18.

Through empirical testing, we have found that it is possible to prevent micro-roughness in the outer surface of the bimetallic part that would otherwise occur due to indentation of the powder particles of the powdered metal material 22. Specifically, we have found that indentation of the powder particles can be eliminated if the environmental metal material 18 is deposited onto the inner surface 16 to a depth that is preferably greater than or equal to approximately one half of a largest particle diameter of the powdered metal material (i.e., about one-half of the diameter of the largest particle of the powdered metal material 22).

After the tool assembly 10 has been removed from the autoclave, the tool 12 is removed from the inner core 24 and the environmental metal material 18. In the particular embodiment provided, the tool 12 is deposited in an acid bath (not shown) that dissolves the tool 12. The acid is selected on the basis of its reactivity with the material of the tool 12 and its non-reactivity with the environmental metal material 18. Accordingly, those skilled in the art will appreciate that the tool 12 is sacrificial in the particular example provided.

Figure 4:
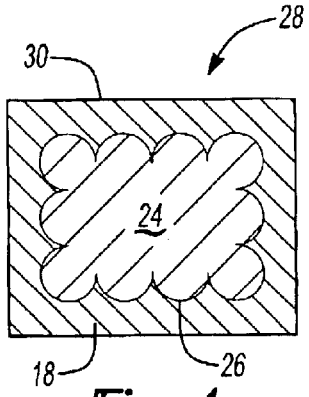
FIG. 4 is a schematic view of a net-shaped bimetallic part with a diffusion bonded environmental surface according to the present invention.

There is shown in FIG. 4 a net-shaped bimetallic part 28 made according to the method of the present invention. The net-shaped bimetallic part 28 includes the inner core 24 at least partially surrounded by the environmental metal material 18. As described above, the environmental metal material 18 is diffusion bonded to the inner core 24. The environmental metal material 18 has a surface 30 matching that of the tooling surface 16 of the tool 12. The net-shaped bimetallic part 28 may be of any shape or configuration, for example a bladed disk (blisk) for use in a turbine, housings, manifolds, nozzles, preburners, etc.

The above description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of manufacturing a bimetallic part comprising the steps of:

providing a tool that defines a cavity and a tooling surface;

depositing a layer of an environmental metal material onto said tooling surface, wherein said environmental metal material is deposited on said tooling surface to a depth of approximately one half of a largest particle diameter of the powdered metal material;

filling said cavity in said tool with a powdered metal material such that said powdered metal material contacts said environmental metal material; and simultaneously heating said tool and subjecting said tool to a pressurized gas to compact said powdered metal material and diffusion bond said environmental metal material to said compacted powdered metal material to thereby form said bimetallic part.

2. The method of manufacturing a bimetallic part of claim 1, wherein prior to heating said tool, the methodology includes the steps of:

degassing said powdered metal material; and sealing said tool.

3. The method of manufacturing a bimetallic part of claim 1, wherein after heating said tool, the methodology includes the step of removing said tool from said environmental metal material.

4. The method of manufacturing a bimetallic part of claim 3, wherein an acid is employed to chemically remove the tool from the environmental metal material.

5. The method of claim 4, wherein the tool is formed from a ferrous material.

6. The method of manufacturing a bimetallic part of claim 5, wherein said ferrous material is high purity iron with low carbon content.

7. The method of manufacturing a bimetallic part of claim 1, wherein said environmental metal material is selected from a group consisting of nickel-based superalloys, iron-based superalloys and 300-series stainless steels.

8. The method of manufacturing a bimetallic part of claim 1, wherein said powdered metal material is a 720-alloy.

9. The method of manufacturing a bimetallic part of claim 1, wherein said environmental metal material at least partially forms an outer surface of said bimetallic part.

10. The method of manufacturing a bimetallic part of claim 1, wherein said environmental metal material is deposited onto said tooling surface using a method from a group consisting of low pressure plasma spraying, wire arc spraying, kinetic energy metallization, direct laser deposition and air plasma spraying.

11. The method of manufacturing a bimetallic part of claim 1, wherein said bimetallic part is a net-shaped bladed disk.

12. The method of manufacturing a bimetallic part of claim 1, wherein said powdered metal material indents said environmental metal material during the step of heating said tool and subjecting said tool to a pressurized gas.

13. A method of manufacturing a bimetallic part comprising the steps of:

providing a tool that defines a cavity and a tooling surface;

depositing a layer of an environmental metal material onto said tooling surface, wherein said environmental metal material is deposited on said tooling surface to a depth of approximately one half of a largest particle diameter of the powdered metal material;

filling said cavity in said tool with a powdered metal material such that said powdered metal material substantially fills said environmental metal material; and hot isostatically pressing said tool to consolidate said powdered metal material and bond said environmental metal material to said consolidated powdered metal material to thereby form said bimetallic part.

14. The method of manufacturing a bimetallic part of claim 13, wherein said environmental metal material at least partially forms an outer surface of said bimetallic part.

15. The method of manufacturing a bimetallic part of claim 13, wherein said environmental metal material is deposited onto said tooling surface using a method from a group consisting of low pressure plasma spraying, wire arc spraying, kinetic energy metallization, direct laser deposition and air plasma spraying.

16. The method of manufacturing a bimetallic part of claim 13, wherein prior to heating said tool, the methodology includes the steps of:

degassing said powdered metal material; and sealing said tool.

17. A method of manufacturing a bimetallic part comprising the steps of:

providing a tool that defines a cavity and a tooling surface;

depositing a layer of an environmental metal material onto said tooling surface;

filling said cavity in said tool with a powdered metal material such that said powdered metal material contacts said environmental metal material;

simultaneously heating said tool and subjecting said tool to a pressurized gas to compact said powdered metal material and diffusion bond said environmental metal material to said compacted powdered metal material to thereby form said bimetallic part; and removing said tool from said environmental metal material, wherein an acid is employed to chemically remove the tool from the environmental metal material.

18. The method of manufacturing a bimetallic part of claim 17, wherein prior to heating said tool, the methodology includes the steps of:

degassing said powdered metal material; and sealing said tool.

19. The method of claim 17, wherein the tool is formed from a ferrous material.

20. The method of manufacturing a bimetallic part of claim 19, wherein said ferrous material is iron.

21. The method of manufacturing a bimetallic part of claim 17, wherein said environmental metal material is selected from a group consisting of nickel-based superalloys, iron-based superalloys and 300-series stainless steels.

22. The method of manufacturing a bimetallic part of claim 17, wherein said powdered metal material is a 720-alloy.

23. The method of manufacturing a bimetallic part of claim 17, wherein said environmental metal material at least partially forms an outer surface of said bimetallic part.

24. The method of manufacturing a bimetallic part of claim 17, wherein said environmental metal material is deposited onto said tooling surface using a method from a group consisting of low pressure plasma spraying, wire arc spraying, kinetic energy metallization, direct laser deposition and air plasma spraying.

25. The method of manufacturing a bimetallic part of claim 17, wherein said bimetallic part is a net-shaped bladed disk.

26. The method of manufacturing a bimetallic part of claim 17, wherein said powdered metal material indents said environmental metal material during the step of heating said tool and subjecting said tool to a pressurized gas.

27. A method of manufacturing a bimetallic part comprising the steps of:

providing a tool that defines a cavity and a tooling surface, wherein the tool is formed from a ferrous material;

depositing a layer of an environmental metal material onto said tooling surface;

filling said cavity in said tool with a powdered metal material such that said powdered metal material contacts said environmental metal material; and simultaneously heating said tool and subjecting said tool to a pressurized gas to compact said powdered metal material and diffusion bond said environmental metal material to said compacted powdered metal material to thereby form said bimetallic part.

28. The method of manufacturing a bimetallic part of claim 27, wherein said ferrous material is iron.

29. The method of manufacturing a bimetallic part of claim 28, wherein said iron has a carbon content that is approximately equal to a carbon content in said environmental material.

30. The method of manufacturing a bimetallic part of claim 28, wherein said environmental metal material is selected from a group consisting of nickel-based superalloys, iron-based superalloys and 300-series stainless steels.

31. The method of manufacturing a bimetallic part of claim 28, wherein said powdered metal material is a 720-alloy.

32. The method of manufacturing a bimetallic part of claim 28, wherein said environmental metal material is deposited on said tooling surface to a depth of approximately one half of a largest particle diameter of the powdered metal material.

* * * * *